United States Patent [19]

Senba

[11] 3,998,252

[45] Dec. 21, 1976

[54] WOOD SLICING APPARATUS

[75] Inventor: Osamu Senba, Hirakata, Japan

[73] Assignee: Matsushita Electric Industrial Co., Ltd., Osaka, Japan

[22] Filed: Apr. 15, 1975

[21] Appl. No.: 568,375

[30] Foreign Application Priority Data

Nov. 20, 1974 Japan ..... 49-134101

[52] U.S. Cl. ..... 144/3 R; 144/162 R; 144/175; 144/182; 144/184; 144/1 R

[51] Int. Cl.[2] ..... B27M 1/08; B27C 9/00

[58] Field of Search ..... 30/162, 335, 337; 100/97; 144/2 D, 3 E, 3 P, 1 R, 147, 49, 3 R, 41, 162 R, 175, 182, 184, 192, 193 R, 193 A–193 K, 194, 195, 309 D, 320, 321, 322; 29/90.5

[56] References Cited

UNITED STATES PATENTS

| | | | |
|---|---|---|---|
| 231,259 | 8/1880 | Beehler | 144/49 |
| 3,538,966 | 11/1970 | Collins | 144/162 R |
| 3,889,368 | 6/1975 | Himeno | 30/335 X |

FOREIGN PATENTS OR APPLICATIONS

| | | | |
|---|---|---|---|
| 1,132,596 | 3/1957 | France | 144/182 |
| 344,295 | 3/1931 | United Kingdom | 144/184 |

*Primary Examiner*—Gary L. Smith
*Attorney, Agent, or Firm*—Wenderoth, Lind & Ponack

[57] ABSTRACT

A wood slicing apparatus for slicing of slats, strips or similar elements from board-shaped base material, with minimum wastage and noise, and maintenance of plane cut surfaces. Boards are initially placed in a loading station from which the topmost board is automatically transferred to a cutting station whereat slats are cut from the board by a cutting unit carrying rigidly held thin cutting blades. The slats are subsequently transferred through smoothing and squaring-off means which apply pressure to smooth both pairs of opposite sides of each slat, during which time the cutting unit is returned to its initial position and the board is advanced to permit severing of further slats therefrom, this action being repeated until there is insufficient board material for removal of further slats, whereupon the apparatus is automatically stopped.

8 Claims, 10 Drawing Figures

WOOD SLICING APPARATUS

This invention relates to an apparatus for cutting wood without forming a kerf. More particularly the invention relates to an apparatus for cutting wood into slats or strips without producing sawdust, without further finishing work being required on slats or strips produced, and without generating excessive noise.

In the woodworking industry it is commonly required to produce, from boards for example, slats of wood which are comparatively long and are required to be square or rectangular in cross-section, examples of such slats being re-inforcement slats employed to maintain the form of loudspeaker boxes for stereophonic or other audio equipment, or style strips applied to the exterior of wardrobes or similar items of furniture. Two problems associated with cutting of wood in general are noise, which may be such that it imposes restrictions on location of a workshop for cutting wood, and sawdust, which may represent a considerable proportion of wood that is wasted. This latter problem is particularly acute in production of re-inforcement slats, style strips, or similar elements, since the kerf formed by a saw for example may be of the order of 2.4 mm to 3.0 mm, while the finished slat may be only several tens of millimeters in width or depth, and there is an unduly high rate of wastage. Another problem in woodcutting processes is that of obtaining an item that is finished i.e., that is made ready for immediate use, in a single operation, without necessity of further work such as planing, which apart from being time and labour consuming, represents further wastage of material. Again this problem is particularly acute in the production of slats or similar items, since tolerances for these items are comparatively close. If production of furniture or loudspeaker boxes, for example, is to be conducted on any scale, it is desirable for it to be possible to position and bond a style strip or re-inforcement slat to a main unit without having to make any adjustments to finish or dimensions of the slat or strip, but still maintaining good appearance and guaranteeing effective attachment.

Progress in the reduction of noise and elimination of sawdust has been afforded by apparatuses shown and described in U.S. Pat. Nos. 2,717,012 and 2,919,731 issued in the name of Schneider. These patents disclose apparatuses wherein lumber is split by being pushed past one or more cutting blades, which are rotary and of which there may be a series of increasing diameter, lumber to be cut being moved into contact with successively larger blades. However, while there are the advantages of reduced noise and sawdust, and hence of economy and of effective lack of restriction of workshop location, blades in these apparatuses act as successive wedges tending to split the wood, which is therefore often left with a cut surface which is unsightly, and which may be very difficult to position in a corner portion of a unit, or to bond to a flat surface. In addition to this, although the apparatuses disclosed function well presuming perfect setting and alignment of cutting blades, since these blades are rotated and are also subject to the force of lumber pushed against them, it is very easy for the rotatably mounted portions of the blades to be slightly displaced from the requisite settings after the apparatus has been in use for a certain amount of time, resulting in blade wobble and unsatisfactory wavy cut surfaces.

Another improved apparatus for kerfless cutting of wood is disclosed in U.S. Pat. No. 3,494,396 issued in the name of Collins. According to this patented apparatus there is provided a cutting blade which is reciprocated at a high frequency and run at a relatively high temperature, and various roll means for guiding and driving a cant into the cutting blade. Instead of a single blade there may be provided a plurality of blades cutting from opposing sides of a cant. However, this apparatus while eliminating sawdust creates a great deal of noise. Also, whether one or a plurality of blades is employed, since blades are reciprocated at high speed, it requires only a very slight misalignment of a blade from a requisite setting for there to be produced waviness of cut surfaces, which are unsatisfactory for elements such as style strips.

All the apparatuses of the patents cited above offer various advantages but are suited primarily to cutting of large pieces of lumber, into boards, for example, but are not suited to production of smaller elements such as slats. In particular, in all of the apparatuses referred to above wood to be cut is moved past blades mounting position of which is stationary. This procedure is satisfactory if large pieces of lumber are to be cut into elements having approximately finished dimensions, but reinforcement slats and style strips, or such elements, are generally cut from comparatively thin boards, which are difficult to control precisely in such a movement.

In order to eliminate the disadvantages inherent in conventional apparatus, it is an object of the present invention to provide a wood-cutting apparatus wherein slat-like elements can be cut from board-shaped base material with a minimum of chips or waste wood produced or noise generated and good squareness of cut surfaces with adjacent surfaces of elements produced is maintained.

It is another object of the invention to provide a wood slicing apparatus wherein slats or other elements produced have good appearance large effective surfaces permitting bonding thereof onto other objects.

A further object of the invention is to provide a wood slicing apparatus making it possible to simultaneously produce a plurality of slats or similar elements in one and the same operation.

A still further object of the invention is to provide a wood slicing apparatus having cutting blades which are thin but not liable to deflection or bending, and which make it possible to apply thereto fresh cutting tip portions as required.

Another object of the invention is to provide a wood slicing apparatus permitting easy mounting, disassembly, and replacement of cutting blades.

Yet another object of the invention is to provide a wood slicing apparatus permitting continuous automatic production of a series of slats or similar elements having good appearance, good squareness, and presenting large effective areas for bonding.

According to the invention there is provided an apparatus in which boards to be cut are initially set in a loading station from which, upon starting of the action of the apparatus, the uppermost board is automatically lifted and moved to and held in a cutting station. A cutting unit comprising a comparatively heavy transport member carrying a blade holding unit wherein sets of plates, which, being bolted to one another and to the transport member are firmly clamped together but are also easily disassemblable, rigidly hold a plurality of opposed blades for making successively deeper cuts in a board, from a shallow initial cut to a final severing cut, is moved along a path parallel to one side of the board and cuts therefrom at least one slat. In one preferred embodiment of the invention described below, two slats are cut off simultaneously with each forward stroke of the cutting unit, in order to improve the efficiency of the apparatus. This mode of slicing wood presents the first advantages that since a board from which slats are to be cut is held stationary there are no problems of accurately guiding a moving board, which is comparatively difficult to maneuver, and if moved against cutting blades is always liable to veer from a desired straight line of travel to a direction following a line of easy cleavage within the wood, and that since the cutting blades are immovable with respect to their carrier, initial settings of blades, and maintenance of these initial settings even after a large number of cutting operations is easily ensured. Also, since the blades are held rigidly and each blade makes only a shallow cut, and the transport member by which they are carried provides weight behind the cutting action, the blades may be made thin, thus ensuring plane cut surfaces.

Slats which are severed from the board are temporarily held by movable support elements which are successively actuated to move to support positions by means actuated by the cutting unit during its cutting stroke, and are then received by a first takeover means in a slats transfer means, whereupon the movable support elements are returned to their initial positions. The slats are taken from the first takeover means by a second takeover means, which separates the slats slightly and then transfers them onto transport means for carrying the slats separately to a smoothing and forwarding station, wherein there are provided means for applying smoothing pressure on two sides of each slat and forwarding the slats to a feed-out and squaring-off means which apply pressure to the other two sides of each slat and feed the slats out of the apparatus, via the discharge portal thereof, the slats thus discharged being immediately useable, without further work or adjustment, as re-inforcement slats for loudspeaker equipment, furniture style strips, or similar elements. During passage of slats through the smoothing and forwarding station, the cutting unit is returned to its initial position, the board from which slats are to be severed is again advanced to and held at the cutting station, and the cutting unit is subsequently advanced again to sever two more slats from the board. This action is repeated until a detection means provided at the cutting station detects that there is insufficient width of board left to permit cutting therefrom of further slats, at which time cutting unit action is temporarily stopped automatically, whereafter the remaining portion of the board is removed manually, and the apparatus is again actuated to commence a cycle of cutting operations on the next topmost board in the loading station.

A better understanding of the present invention may be had from the following full description of one preferred embodiment thereof, when read in reference to the attached drawings, in which like numbers refer to like parts, and FIG. 1 is a front elevational view of a wood slicing apparatus according to one embodiment of the invention;

Figure 1:
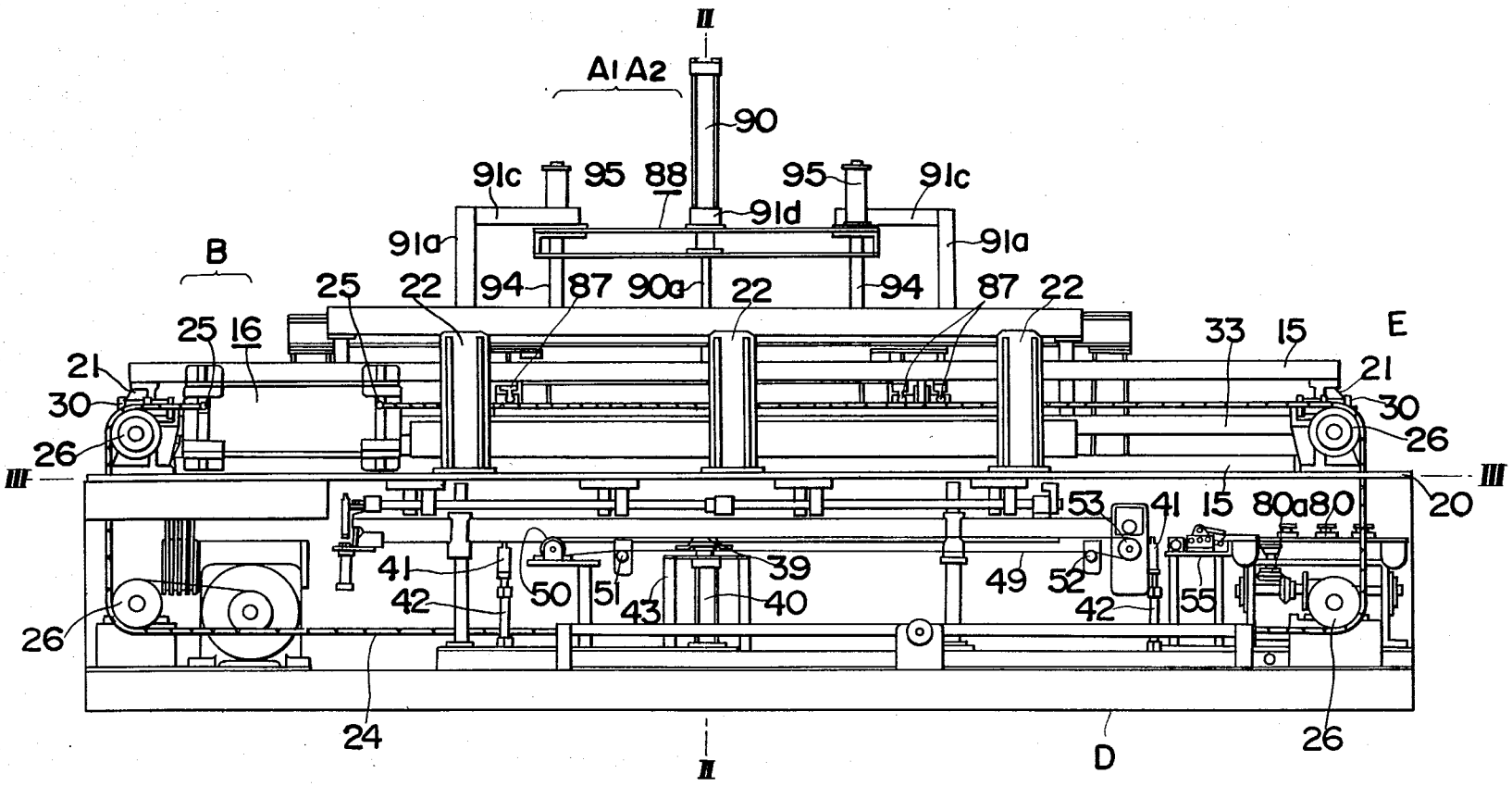
Figure 2:
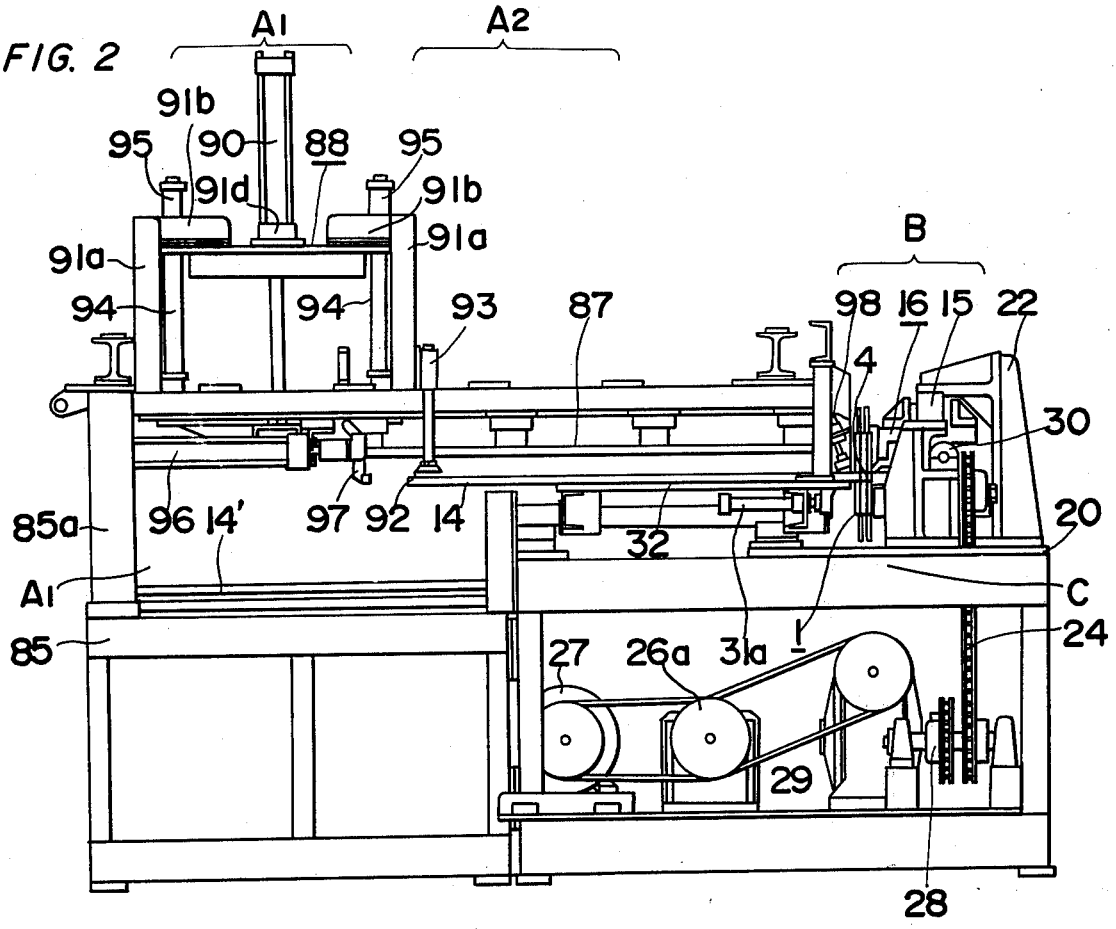
FIG. 2 is a cross-sectional view taken along the line II—II of FIG. 1.
Figure 3:
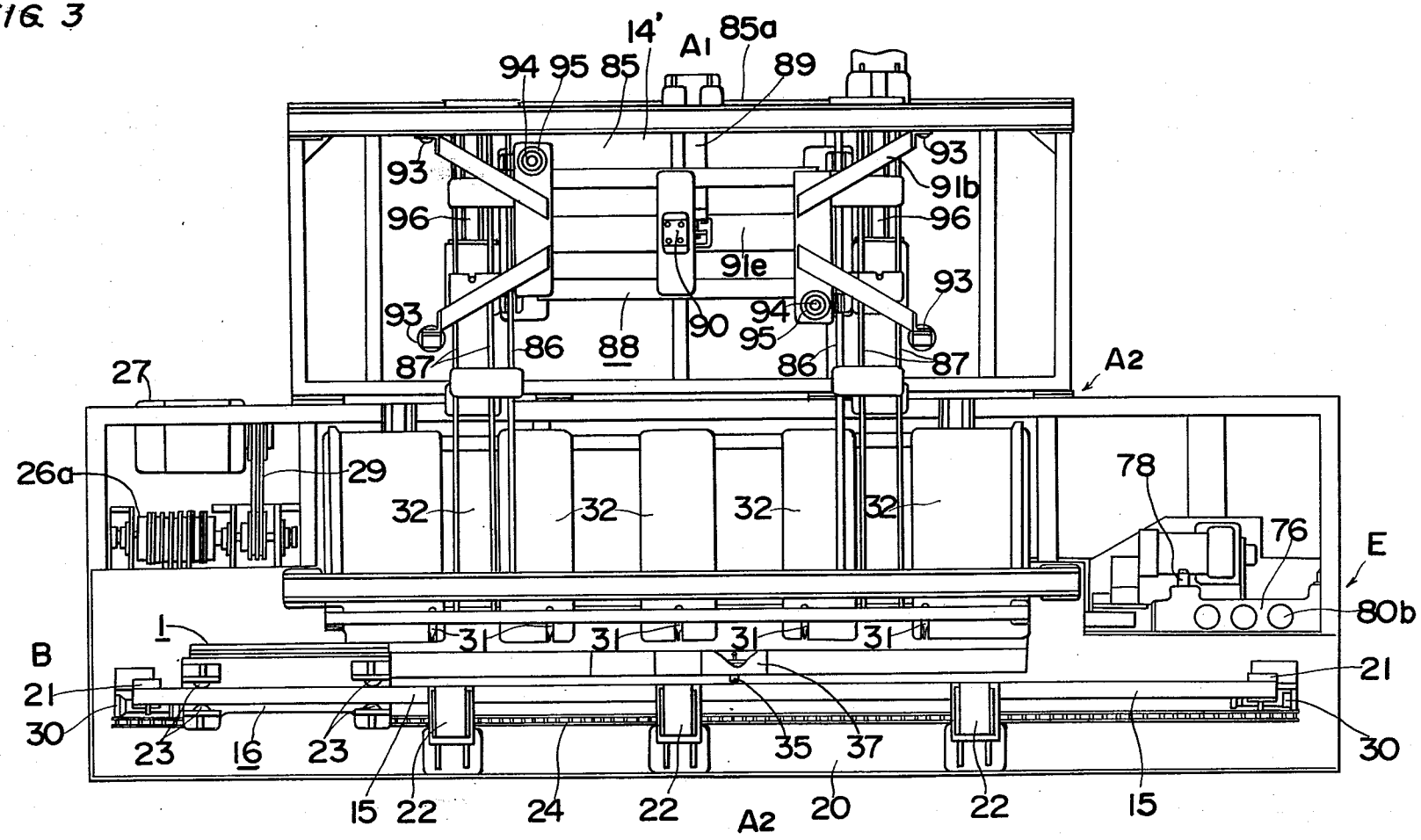
FIG. 3 is a horizontal cross-sectional view taken along the line III—III of FIG. 1.

Referring to FIGS. 1 through 3, the wood slicing apparatus comprises a main frame 20 supporting or enclosing a loading station and cutting station generally indicated at A1 and A2, respectively, a cutting unit B, a slats transfer station designated at C, a smoothing and forwarding staion generally indicated at D, and a squaring-off and feed-out station generally indicated at E. The main features of the operation of the apparatus are in brief as follows. Boards 14 from which slats 14' are to be cut are placed manually into a bay 85 in the loading station A1, from which they are taken at a time by suction cylinders 92 which are associated with a hydraulic cylinder 90, support frame 91, and slide plate 88 described below, and placed on supports 32 at the cutting station A2, each successive board 14 being held in a position ready to have slats 14' severed therefrom by the cutting unit B, which is reciprocally movable across the front of the cutting station A2. The transfer station C comprises first takeover means 39 which receive slats 14' severed from the board 14 and second takeover means 41 by which slats 14' are received from the first takeover means 39 and transferred onto belts 49. The slats 14' are carried by the belts 49 to the smoothing and forwarding station D, from which they are forwarded to the squaring-off and feed-out station E. The stations D and E comprise pressure roll means which act in mutually normal directions, whereby one pair of opposite sides of each slat 14' is smoothed at station D and the other pair of opposite sides thereof of smoothed and squared-off at station E. From station E, slats 14' are forwarded to the exterior of the apparatus, for example, onto a tray not shown. In greater detail, the construction and operation of the apparatus are as follows.

In FIGS. 1 through 3, the bay 85 in the loading station A1 is provided in a rear portion of the apparatus and communicates with a loading portal 85*a* via which boards 14 may be loaded manually into the apparatus and stacked in the bay 85. Provided above the bay 85 there is a pair of fixed rails 86 extending in a front to rear alignment with respect to the apparatus, and having opposite ends fixedly attached to main frame 20 portions at the rear of the loading station A1 and front of the cutting station A2. The support frame 91 is supported on the rails 86 and is slidable therealong in response to expansion and contraction action of a hydraulic cylinder 89, which is supported in a front to rear alignment on the rear wall of the main frame 20 and controls a piston the outer, i.e., forward, end of which is fixedly attached to a strut 91*e* of the support frame 91. The support frame 91 comprises left and right side walls 91*a*, two plates 91*b*, there being one plate 91*b* provided in a front to rear alignment and in fixed attachment to the top of each wall 91*a*, two struts 91*c*, which are in left to right alignment and are fixedly attached to the side walls 91*a*, one strut 91*c* connecting to the rear upper corners of the walls 91*a* and the other strut 91*c* to the front upper corners thereof, and a cross-piece 91*d*, which is in a front to rear alignment and has opposite ends fixedly attached to central portions of the struts 91*c*.

The strut 91*e* connecting to the cylinder 89 is in a left to right alignment, has opposite ends fixedly attached to opposing side walls 91*a*, and is positioned somewhat below the plates 91*b* and somewhat to the rear of the centre of the crosspiece 91*d*. The hydraulic cylinder 90 is vertically aligned and is mounted on the central portion of the cross-piece 91*d*, and controls a downwardly inclined external piston rod 90*a* the lower end of which is fixedly attached to the slide frame 88, which is rectangular and lies below the level of the strut 91*e* of the support frame 91. The slide frame 88 has fixedly attached to diametrically opposite corners thereof vertically aligned slide rods 94, the upper portions of which are slidably accommodated in sleeves 95 which are fixedly mounted in the support frame plates 91*b*, one sleeve 95 being provided at the rear of one plate 91*b* and the other sleeve 95 at the front end of the other plate 91*b*. Thus, the slide plate 88 can be moved reciprocally upwards and downwards relative to the support frame 91, in response to action of the hydraulic cylinder 90, but can not move laterally with respect to the support frame 91. On the other hand, upon actuation of the hydraulic cylinder 89, the slide frame 88 is constrained to move laterally together with the support frame 91 due to the connection of the slide rods 94 and sleeves 95. A downwardly extending suction cylinder 92 connecting to a lower-end suction pad 93 is mounted at each corner of the slide frame 88. Alternatively, there may be provided only two cylinders 92, which are mounted at diametrically opposite corners of the slide frame 88. The length of the suction cylinders 92, which are identical, is such that when the slide frame 88 is in its highest position the level of the suction pads 93 is very slightly higher than that of the supports 32 in the cutting station A2.

The supports 32 are comparatively broad rectangular plates which are fixedly and horizontally mounted on a forward portion of the main frame 20, and, as best shown in FIG. 3, are aligned with one another and disposed in a line extending from left to right with respect to the apparatus.

Upon actuation of the hydraulic cylinder 90 and of the suction cylinders 92, the slide frame 88 is lowered and the suction pads 93 are brought into contact with, and apply holding suction to the topmost board 14 in the bay 85. The length of the stroke of the piston 90*a* of the cylinder 90 is sufficient for the slide frame together with the suction cylinders 92 to be lowered far enough for the suction pads 93 to be brought into contact with the lowermost board 14 in the bay 85. To avoid any seizure or forcing of equipment when there is a considerable number of boards 14 in the bay 85, there may be provided control means for suitable adjustment of the force applied by the hydraulic cylinder 90, or the suction cylinders 92 may be mounted in sleeves which are attached to corners of the slide frame 88, and which permit the cylinders 92 to move upwards and downwards relative to the slide frame 88 over a limited range approximately equal to the total thickness of the maximum number of boards 14 which may be accommodated in the bay 85, the latter alternative being simplier. With the suction pads 93 still gripping the board 14 the hydraulic cylinder 90 is actuated to move the slide frame 88 to its uppermost position, whereby the board 14 is raised to a level slightly above that of the supports 32. During this motion the cylinders 93, if sleeve-mounted, simultaneously move to their lowermost positions relative to the slide plate 88. The hydraulic cylinder 89 is now actuated to advance the support frame 91, which carries the slide frame, suction cylinders 92 and board 14 to a position above the supports 32. Hereupon the suction action of the cylinders 92 is terminated and the pads 93 release the board 14, which is retained by the supports 32. After this the hydraulic cylinder 89 is actuated to draw the support frame 91 and slide frame 88 back to their original positions.

As shown most clearly in FIGS. 2 and 3, on the rear wall of the main frame 20 there are mounted two forwardly extending air cylinders 96, which are in line with opposite side portions of the cutting station A2 and are generally level with the supports 32. Each air cylinder controls a push element 97, which is rotatable a certain amount and which comprises forwardly-extending grip projections provided on opposite sides thereof, and is slidable along a pair of rails 87 which have the opposite ends fixedly attached to the main frame rear wall and a main frame 20 portion at the front of the cutting station A2, and which passes between two supports 32. When pushed against an object, in this case the board 14, each push element 97 turns until the grip projections thereof are brought against opposite sides of the board 14, whereby the push element 97, will push the board 14 in a straight line. When the suction cylinders 93 have transferred a board 14 onto the supports 32 and released the board 14, the air cylinders 96 are actuated to advance the push elements 97, which, sliding along their respective rails 87, are brought into contact with and grip the rear edge of the board 14, and as the forward pushing action of the air cylinders 96 continues, push the board 14 forwards until the front edge thereof is brought against stops 37, which are described in greater detail below. When the board 14 has been brought to this position a plurality of downwardly and forwardly inclinded push cylinders 98 provided above the forward end of the cutting station A2 are actuated, and the pistons 98*a* thereof exert forward and downward pressure on the board 14, which is thereby retained in a position wherein the front edge portion thereof extends over a gap defined between the front sides of the supports 32 and the rear sides of the stops 37*a*. After this the air cylinders 96 are actuated to withdraw the push elements 97 to their original positions.

Still referring to FIGS. 2 and 3, during motion of the cutting unit B across the front of the cutting station A2 the cutter blade holder 1 thereof travels along the gap and during the forward stroke of the cutting unit B, defined below, the front edge portion 14*a* of the board is severed from the remainder of the board 14*b*, and cut into two slats 14'. To prevent these slats 14' from falling there are provided movable support elements 31, of which there is at least one associated with each support 32, and which are movable to forward or rearward positions by air cylinders 31*a*, which are themselves actuated in response to actuation of microswitches, not shown, provided in the path of the cutting unit B. In their forward positions, the movable support elements 31 extend almost completely across the gap. In its rearward position, each support element 31 is completely accommodated in a recess formed in the front end portion of a support 32. Immediately after passing the location of a movable support element 31, the cutting unit B actuates a microswitch to cause the corresponding air cylinder 31*a* to push the support element 31 outwards to its forward position, in which it supports the slat 14' portions that have just been cut. In this manner successive support elements 31 are moved outwards and support the slats 14' after the latter have been completely detached from the board 14.

Still referring to FIGS. 2 and 3, and also referring back to FIG. 1, the cutting unit B comprises a transport member 16 which carries the cutter blade holder 1, and is moveable reciprocally between opposite sides of the apparatus. The transport member 16 is guided in this motion by a pair of rails 15, along which the top and bottom portions of the transport member 16 roll, and which are each supported by and in fixed attachment to mounting and spacer elements 21 fixed to opposite sides of the main frame 20. The mounting and spacer elements 21 also support an intermediate rail 33 which lies between the rails 15, has opposite ends fixed to opposite mounting and spacer elements 21, and passes through a central opening formed in the transport member 16, as described in greater detail below. Since it carries most of the weight of the transport member 16, the bottom rail 15 is preferably, but not essentially, made comparatively broad and sturdy, whereas the upper rail 15, which acts mainly as a guide, is made generally square in cross-section. To ensure rectilinearity of the rails 15 there are further provided at regular intervals strut plates 22 which are fixed to the main frame 20 and to the outer, i.e., forward, side of the rails 15.

The transport member is driven in its reciprocal motion by a chain 24 which is passed tautly around four sprockets 26 rotatably mounted at four corner portions of the front portion of the main frame 20, and is fixedly attached at opposite ends to the left and right sides of the transport member 16 by means of pins 25. A motor 27, which is provided in a lower portion of the area defined by the main frame 20, acts through an electomagnetic clutch 26*a*, drive belt 29, and other suitable gears or drive transmission elements to drive a sprocket 28 which is fixedly mounted on the same shaft as one sprocket 26, whereby upon forward or reverse actuation of the motor 27 and engagement of the clutch 26*a* the chain 24 is rotated to draw the transport member 16 from one side of the apparatus to the other. For the purposes of the present description, forward drive of the motor 27 is taken to mean drive such as to cause the transport member 16 to be drawn form the left to the right hand side of the apparatus as seen in FIG. 1, during which motion slats 14' are cut from a board 14, and reverse drive of the motor 27 to be drive such as to cause movement from the right to the left-hand side of the apparatus. At each opposite side of the apparatus there is provided a buffer 30 for effecting gentle stopping of the transport member 16. Adjacent to each buffer 30 there is a microswitch, not shown, which the transport member actuates just before reaching the buffer 30, and which when thus actuated causes disengagement of the clutch 26*a*, whereby the motor 27 is temporarily disconnected from the sprocket 28, or chain 24.

Figure 4:
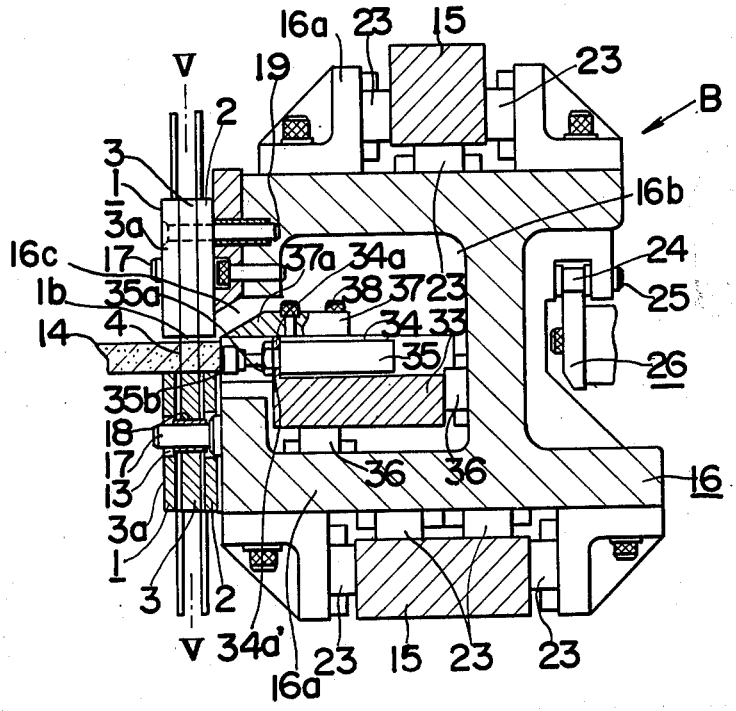
FIG. 4 is a cross-sectional view of a cutting unit employed in the apparatus of FIG. 1.

Referring now to FIG. 4, which shows the cutting unit B in cross-section, the transport member 16 may be seen to comprise top and bottom rail accommodation portions 16*a* through which the upper and lower rails respectively pass. On the inner sides of each rail accommodation portion 16*a* there are mounted rolls 23 contacting three sides of the corresponding rail 15. If the lower rail 15 is made comparatively broad, there are suitably provided two rolls 23 which roll on the upper surface thereof and carry the main part of the weight of the transport member 16. Otherwise there need be only one roll 23 contacting each of the other sides of the rails 15. The transport member has an open central portion 16*b* through which the abovementioned intermediate rail 33 passes, and on two sides of which there are mounted rolls 36 which roll on the lower and forward sides of the intermediate rail 33. The central opening 16*b* communicates with a gap 16*c* defined by the transport member 16 and opening to the rear thereof.

At intervals on the intermediate rail 33 there are concave portions 34, which open upwards, and are constituted as integral portions of the intermediate rail 33 or are separate elements fixedly attached to the upper surface thereof, and are in line with the gap 16*c*. Each concave portion 34 comprises a rear wall 34*a*, which is generally level with the rear side of the rail 33, and in which there is formed a small opening 34*a'*. A hydraulic cylinder 35 having an actuation rod on the terminal end of which there is fitted a comparatively large pusher element 35*b* is accommodated horizontally in each concave portion 34, the cylinder pusher element 35*b* being directed rearwardly, and the neck portion of the cylinder 35 passing through the hole 34*a'* in the concave portion rear wall 34*a* and being secured by a nut 35*a*. The pusher element 35*b* of each cylinder 35 is normally, i.e., during non-actuation of the cylinder 35, slightly forward of the rear edge of the transport member 16. Above and covering each concave portion 34 and cylinder 35 accommodated therein, there is provided a covering retainer 37, which is fixedly attached to the intermediate rail 33 by one or more bolts 38 and further has a rearwardly extending portion constituting a board stop 37*a*, which has a rear surface generally in line with the rear side of the transport member 16, and in which there is formed an opening in which the actuation rod and push portion 35*b* of the corresponding cylinder 35 are completely accommodated during non-actuation of the cylinder 35, and which is large enough to permit free movement of the actuation rod and pusher element 35*b*. As noted earlier, the rear edges of the stops 37*a*, together with the front edges of the supports 32, define a gap over which the front edge portion of a board 14 to be sliced lies.

Figure 5:
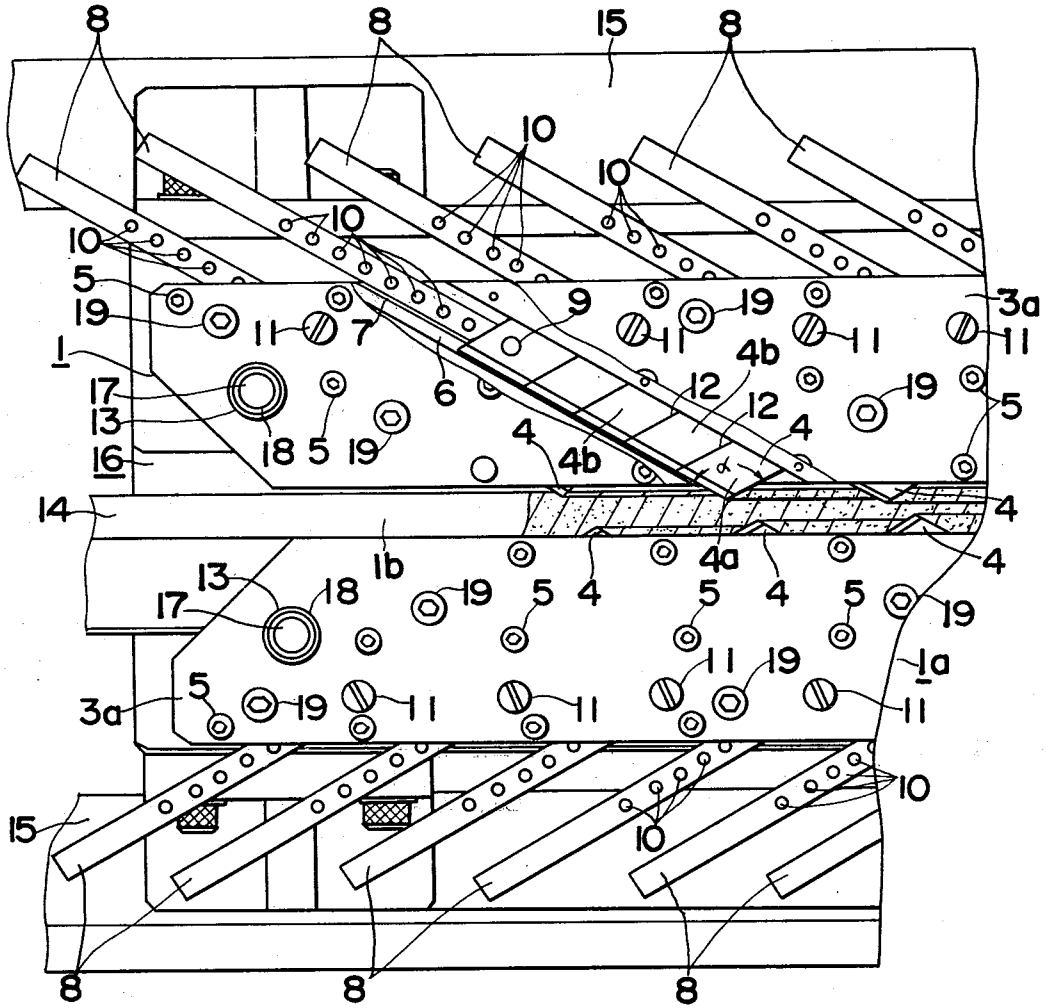
FIG. 5 is a cross-sectional view taken through the line V—V of FIG. 4 and showing details of the manner of mounting cutting blades in a blade holding unit.

Still referring to FIG. 4 and also referring to FIG. 5, the cutter blade holder 1 comprises two sets 1*a* of blade gripping plates 2, 3 and 3*a*, all the plates having generally equal dimensions and the two sets 1*a* being in vertical alignment with one another and separated by a horizontal gap 1*b*, which is slightly wider than a board 14 to be cut is thick, and which lies on a line level with the pusher elements 35*b* of the hydraulic cylinders 35. Upon completion of severing of slats 14' from a board 14, pressure of the cylinders 98 is released and the cylinders 35 are actuated to cause the pusher elements 35*b* to push the slats 14' and the reamainder 14*b* of the board 14 rearwards a sufficient distance for the front edge of the board 14*b* to be brought in line with or close to the line of the front edges of the supports 32, whereby, after removal of the slats 14' in a manner described below, return motion of the cutting unit B is unimpeded.

In each plate set 1*a* the plates 2 and 3*a* are the outside plates and are held in exact stacking alignment with the central plate 3 by a plurality of screws or bolts 5, and there are provided through-holes 13, which are constituted by concentric holes of approximately the same size formed in the plates 2, 3 and 3*a*, and which permit the plate set 1*a* to be fitted onto position-location projections 17, which are fixedly attached to and extend rearwardly from the transport member 16, and each have provided around a central portion thereof a circular padder element 18. After initial positioning of each plate set 1*a* by means of the position-location elements 17, the plate set 1*a* is fixedly attached to the transport member 16 by means of a plurality of bolts 19 which pass through the plate set 1*a* and into the transport member 16. In each plate set 1*a* a plurality of thin cutter blades 4 is held between the plates 2 and 3, and a plurality of blades 4 is similarly held between plates 3 and 3*a*.

Referring principally to FIG. 5, each blade 4 is a comparatively long, thin blade having a single cutting edge of which only one end portion 4*a*, which projects into the gap 1*b*, does cutting work in any one board slicing operation, the manner of mounting of each blade 4 being as follows. The blade 4 is accommodated in a positioning groove 6, which is formed in one side of the central gripping plate 3, which lies at an acute angle, with respect to the direction of current movement of blades, to the edge of plate 3, and hence to the gap 1*b*, and which has a width closely matching that of the blade 4, whereby once accommodated in the groove 6 the blade 4 can not move laterally. To prevent longitudinal displacement of the blade 4, there is provided a long, rectangular retainer element 8, which is made of a suitably rigid material and is narrower than the blade 4, in which there is formed a plurality of holes 10 disposed at intervals along the longitudinal axis thereof, and at one end of which there is a fixedly attached stud 9 which fits into a hole at the rear end of the blade 4, i.e., the end thereof further removed from the gap 1*b*. The retainer element 8 is accomodated in a groove 7 in the plate 3, having a longitudinal axis aligned with that of the groove 6, and affording close-fitting accommodation to the retainer 8. Retention of the retainer element 8 itself in a fixed position is effected by means of a fixing pin or screw 11, which passes through an outside gripping plate, i.e., plate 2 or 3*a*, through a hole of the retainer element 8, and into the central plate 3. Thus the blade 4 can be advanced into the gap 1*b* by removing the screw 11, advancing the retainer element 8 towards the gap 1*b*, then securing the screw 11 into a next hole 10. The angle $\alpha$ at the blade cutting end 4*a* projecting into the gap 1*b*, i.e. the angle between the cutting edge and the end of the blade, is obtuse, whereby, although the blade 4 is thin, strength is imparted to the cutting end 4*a*. After repeated cutting operations it is evident that the blade 4 cutting edge at the cutting tip 4*a* becomes worn. There are therefore provided in the blade 4 snap-off grooves 12, which are formed at intervals each equal to an interval between two holes 10 in the retainer element 8, which extend across the width of the blade 4 and are disposed parallel to the front end of blade 4, the blade 4 thus being, in effect divided into a plurality of equal-sized portions 4*b* each defining a cutting end 4*a*. When a cutting end 4*a* projecting into the gap 1*b* becomes worn, the retainer element 8 and blade 4 may be advanced and refixed in the manner described above, and the terminal blade portion 4*b* snapped off along the line of a groove 12 to expose a new cutting end 4*a*.

Still referring to FIG. 5, the blades 4 in the upper plate set 1*a* are generally opposite to those in the lower plate set 1*a*, but all blades 4 are at the same angle with respect to the gap 1*b* and are provided at equal intervals in their respective sets 1*a*, the successive cutting ends 4*a* of the blades 4 in the upper set 1*a* being in a slightly staggered relationship in the cutting direction to the successive cutting ends 4*a* of the lower set blades 4. In each set 1*a* each successive blade 4 projects further into the gap 1*b* than the preceding blade 4 in the direction of cutting, the different retainer elements 8 having different spacings between end studs 9 and nearest holes 10. The amount of advance of each successive blade 4 into the gap 1*b* is the same for both the upper plate set 1*a* and the lower plate set 1*a*. Thus, as the transport member 16 is advanced along the rails 15, the rigidly held blades 4 of each gripping plate set 1*a* make successively deeper cuts into opposite sides of a board held in position at the cutting station A2, and the work required to be done by each blade 4 is comparatively small since it cuts only a little deeper than the preceding blade. Also, since the blades 4 are held rigidly in the blade holder 1 and have the benefit of the weight of the transport member 16, the board 14 is cut smoothly and the cut surfaces have good flatness. The first blades 4 held in the upper and lower sets 1*a* make only shallow initial cuts, and the last blades 4 held therein extend as far as the centre line of a board 14, whereby slats 14' are completely severed from the board 14. In this embodiment of the invention two slats 14' are severed for each forward stroke of the cutting unit B. It is evident, however, that it is equally possible for the cutting unit B, without any major modification thereto, to cut off only one slat 14', or more than two slats 14'.

Slats 14' cut from the board 14 are removed from the cutting station A2 by the elements of the transfer station C, which is located below the cutting station A2, as shown most clearly in FIG. 1, and which comprises the abovementioned first takeover elements 39, second takeover elements 41. Transport belts 49 are provided parallel to one another in a left to right alignment, and are each driven by a pair of pulleys 50 and 53, which are rotatably mounted on shafts fixedly attached to the main frame 20, the top stretch of each belt 49 being horizontal and there being provided near opposite ends of the lower stretch thereof snub pulleys 51 and 52 to maintain requisite belt tautness. Both belts 49 are suitably driven simultaneously by a common motor, not shown, which supplies drive to pulleys 50, for example. The first takeover elements 39, of which only one is shown, but of which there is provided a suitable number, for example three, are disposed at equal intervals between the belts 49, and the second takeover elements 41 are positioned in line with the first takeover elements 39 and a short distance to the left and right of opposite ends of the belts 49. Transfer station C elements are shown in greater detail in FIGS. 6 and 7, to which reference is now had.

Each first takeover element 39 comprises a V-shaped receptacle portion 39*a* to opposite sides of which are fixedly attached the upper ends of vertically aligned slide rods 47 for support and maintenance of alignment of the receptacle portions 39*a*, and the central portion of the lower surface of which is attached to the upper end of the external piston of a vertically aligned hydraulic cylinder 40. The cylinder 40 is supported by a horizontal crosspiece 43*a* having the opposite ends fixedly attached to vertical support struts 43 which are fixedly mounted on a portion of the main frame 20. In the crosspiece 43*a*, on opposite sides of the cylinder 40 there are fixedly mounted sleeves 45 in which the support rods 47 are slidably mounted. All the first elements 39 have an identical construction and are aligned so that the roots of the Vs defined by the receptacle portions 39*a* thereof lie on the same line. Upon actuation of the cylinders 40 to raise the pistons thereof, the receptacle portions 39*a* are raised, passing between two supports 32, as indicated by the chain-dot line portions of FIGS. 6 and 7, whereupon the air cylinders 31*a* are actuated to withdraw the support elements 31, leaving the slats 14' supported by the first takeover elements 39. After this the hydraulic cylinders 40 are actuated to withdraw the pistons and the first takeover elements 39 are lowered and carry the slats 14' downwards. Because of the V-shaped configuration of the receptacle portions 39*a* of the first takeover elements 39, the bottom edges of the slats 14' are not able to meet, and as the first takeover elements 39 are moved downwards, to the position indicated by the solid line portions of FIGS. 6 and 7, the slats 14' tilt towards one another, the bottom edges thereof being separated by a small gap.

Figure 7:
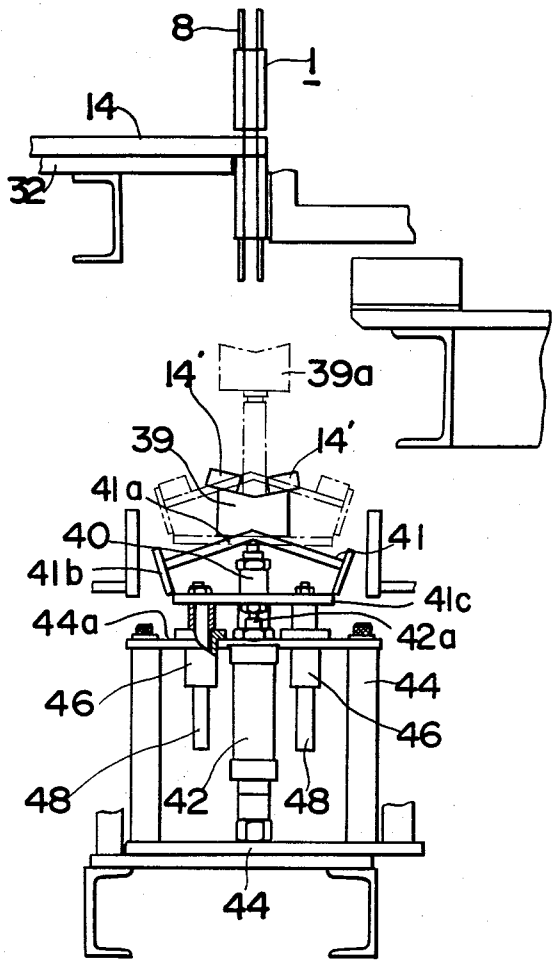
FIG. 6 and FIG. 7 are respectively front and side elevational view, partly in section, of first and second slats takeover means and transport means provided in a transfer station of the apparatus of FIG. 1.

As seen in FIG. 7, each of the second takeover elements 41 has a top portion 41*a* in the shape of an inverted V, which is broad and gently sloped, and slat retainer walls 41*b* extending at right-angles to opposite ends of the V. The height of the walls 41*b* is at least equal to and preferably slightly greater than the thickness of the board 14. Support for the second takeover element 41 is provided by a pair of vertical struts 44 which are fixedly mounted on the main frame 20, and to the opposite top ends of which are fixedly attached opposite ends of a horizontal crosspiece 44*a*. The crosspiece 44*a* provides mounting support to a vertically aligned hydraulic cylinder 42 having an external piston 42*a*, and two sleeves 46 which are provided on opposite sides of the hydraulic cylinder 42, and in which there are slidably mounted vetical slide rods 48.

Figure 6:
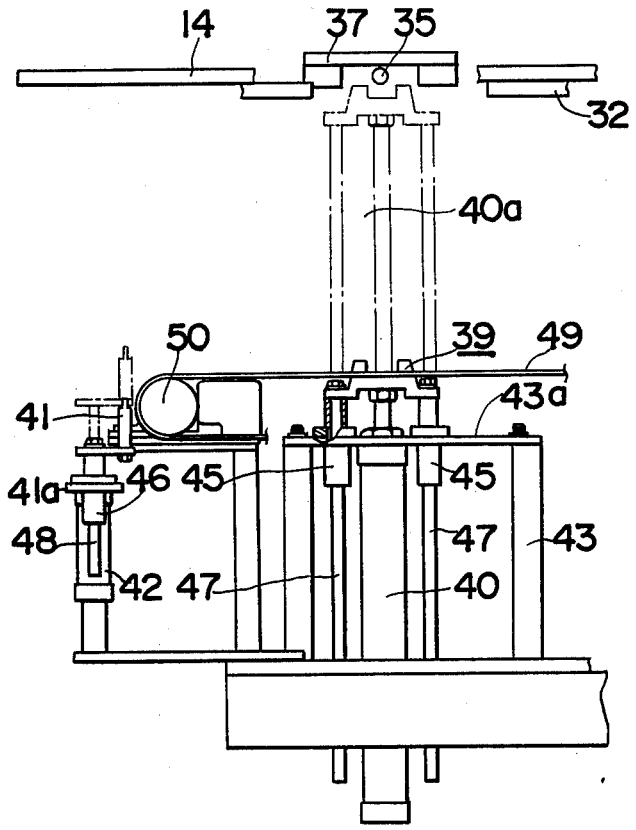

In FIGS. 6 and 7, the tops of the slide rods 48 and of the piston 42*a* are fixedly connected to one side of a small horizontal support plate 41*c*. The second takeover element 41 extends vertically upwards from and is fixedly supported on the opposite side of the plate 41*a*. Normally, as indicated by the full line portion of FIG. 6, the second takeover element 41 is in a lowermost position wherein the top thereof is lower than the top run of the transport belts 49. Upon actuation of the cylinder 42 to push the piston 42*a* thereof upwards, the second takeover element 41 is raised to a level which is higher than the top run of the belts 49, and which is also higher than the first takeover element 39 when this latter element is in its lowermost position. The other second takeover element 41 provided slightly beyond the opposite ends of the belts 49 has an identical construction, and the second takeover elements 41 are so positioned and have dimensions such that an imaginary line joining the apices of the upper surface V-shaped portions thereof will pass exactly through the roots of the Vs formed by the receptacle portions 39*a* of the first takeover elements 39, and that the retainer walls 41*b* at the forward side thereof, i.e. the forward side with respect to the apparatus, are aligned with the longitudinal axis of the forward side belt 49, and the rear side retainer walls 41*b* thereof with the longitudinal axis of the rear side belt 49.

As illustrated most clearly in FIG. 7, while the first takeover elements 39 are moved downwards due to the action of the cylinders 40, the second takeover elements 41 are moved upwards simultaneously by their respective cylinders 42. The first takeover elements 39 are brought level with the topmost positions of the second takeover elements 41 a very short time before the second takeover elements 41 reach their topmost positions. Thus, as the first takeover elements 39 move downwards, the apices 41*a* of the upper surface V-shaped portions of the second takeover elements 41 move into the gap between the lower edges of the slats 14' carried on the first takeover elements 39, and as the first takeover elements 39 continue to move downwards, and the second takeover elements 41 continue to move upwards slightly, the slats 14' divide and slide down the sides of the top surface V-shaped portions of the second takeover element until they come into contact with the retainer walls 41*b*. The second takeover elements 41, now carrying the slats 14', are lowered, and when they reach and pass below the level of the transport belts 49, which are rotated at this time, the slats 14' automatically disengage from the second takeover elements 41 and are laid on the belts 49, which advance the slats 14' to the smoothing and forwarding station D.

Figure 8:
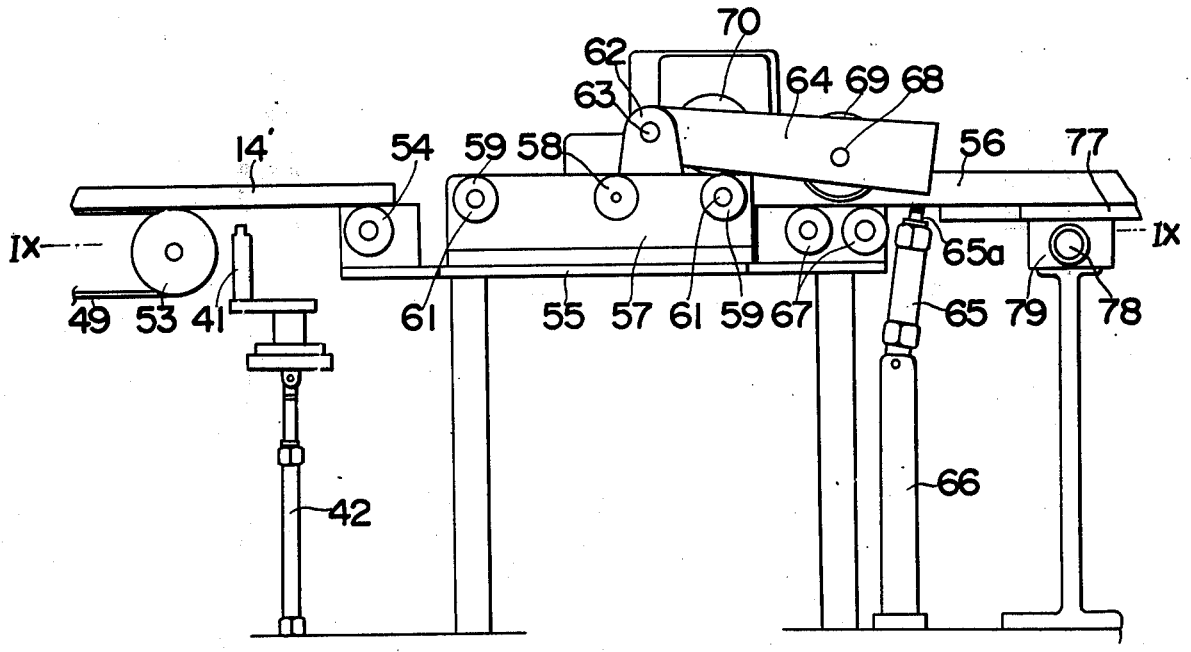
FIG. 8 is a front view of a smoothing and forwarding station employed in the apparatus of FIG. 1.
Figure 9:
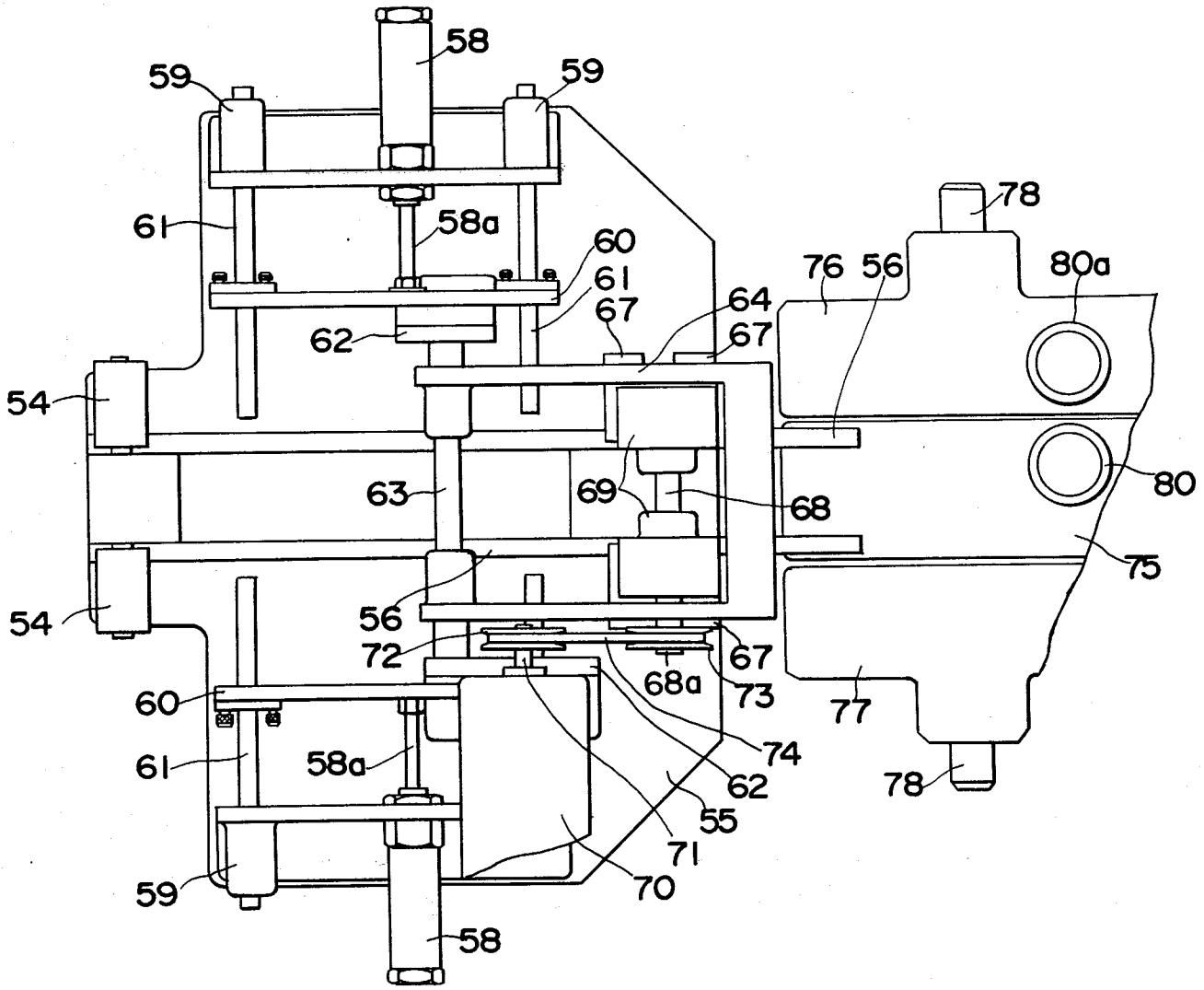
FIG. 9 is a cross-sectional view taken along the line IX—IX of FIG. 8.

The smoothing and forwarding station D, which is shown in detail in FIGS. 8 and 9, comprises a flat-topped support frame 55. At the left-hand side of the support frame 55, i.e., the side thereof nearest the transfer station C, there is provided a pair of rollers 54, each of which is in line with one belt 49, and onto which slats 14' are fed from the belts 49, thus permitting smooth transfer of slats 14' from station C to station D. Provided in a generally central portion of the upper surface of the support frame 55 there are two positioning walls 56, which are in a left to right alignment and parallel to one another, and which extend from the vicinity of the rollers 54 to beyond the right-hand edge of the support frame 55 and project a slight distance into the upper portion of the squaring-off and feed-out station E. Each slat 14' fed by a belt 49 onto a roller 54 is moved onto the support frame 55 and along the side of a positioning wall 56, the rear slat 14' being moved along the rear side of the rear wall 56, and the forward slat 14' along the frontside of the front wall 56. The front end of each slat 14' thus fed onto the support frame 55 is eventually brought to a position contacting the upper sides of a pair of rollers 67 which are rotatable about a horizontal axis and are mounted near the right-hand edge of the support frame 55.

The slat 14' on each pair of rollers 67 is pressed into firm contact therewith by a large drive and press roll 69, which is also rotatable about a horizontal axis, there being one press roll 69 for each pair of rollers 67. The press rolls 69 are provided between the arms of a swivel yoke element 64 and are fixedly mounted on a common shaft 68, which has opposite end portions rotatably mounted in opposite arms of the yoke element 64, and has one end 68*a* projecting to the outside of the yoke element 64. Fixedly mounted on the shaft outer end 68*a* there is a pulley 73 which is connected by a drive belt 74 to a pulley 72 fixedly mounted on the output shaft 71 of a motor 70, which is mounted on the support frame 55, whereby the drive and press rolls 69 are rotated upon actuation of the motor 70. The outer ends of the arms of the yoke element 64 are pivotally mounted on a shaft 63 which has opposite ends fixedly mounted in the upper portions of fixed tabs 62 provided slightly forward of the support frame central portion. The shaft 63 straddles the walls 56, but is kept clear thereof due to the height of the tabs 62. The cross-piece of the yoke element 64 in to the outer end of the external piston of an air cylinder 65, which is provided in approximately vertical alignment below the level of the support frame 55 upper surface, and is mounted on a fixed pedestal 66, which is itself mounted on the base of the main frame 20. Normally the air cylinder 65 is actuated to hold the yoke element 64 crosspiece up sufficiently to keep the press rolls 69 out of contact with the rollers 67, in which position of the rolls 69 slats 14′ may be moved without hindrance onto the rollers 67. When the slats 14′ have been moved onto the rollers 67, the air cylinder 65 is actuated to pivot the yoke element 64 downwards and cause the rolls 69 to firmly press the slats 14′ against the rollers 67. Actuation of the cylinder 65 is suitably in response to a timer means and is effected after an elapse of a certain time after severing of slats 14′, actuation of the timer means itself being, for example, by the transport member 16 reaching a buffer 30.

Each slat 14′ may be pushed into alignment with its respective wall 56 by a pair of well-spaced push rods 61 which are aligned normally with respect to the wall 56 and are slidably mounted in sleeves 59 provided on a mounting wall fixedly mounted on the support frame 55. Movement of each pair of support rods 61 is controlled by an air cylinder 58 which is mounted in a central portion of the corresponding wall 57, and controls an external piston 58*a* the outer end of which is fixedly attached to a central portion of a crosspiece 60 having opposite ends fixedly attached to the push rods 61. Upon actuation of a cylinder 58 to move the piston 58*a* thereof outwardly with respect thereto, the corresponding crosspiece 60 and push rods 61 are moved towards the corresponding wall 56 and a slat 14′ that has been fed onto the support frame is pushed by the push rods 61 into exact alignment with the wall 56, this action being performed simultaneously by both pairs of push rods 61 after the press rolls 69 have been brought into contact with slats 14′ on the rollers 67. The push rods 61 are then retracted and the motor 70 is actuated, whereby the press rolls 69 are rotated and the slats 14′, while each having pressure applied to smooth two opposite sides thereof are moved along the walls 56 which guide the slats 14′ onto the feed-out and squaring-of station E.

Figure 10:
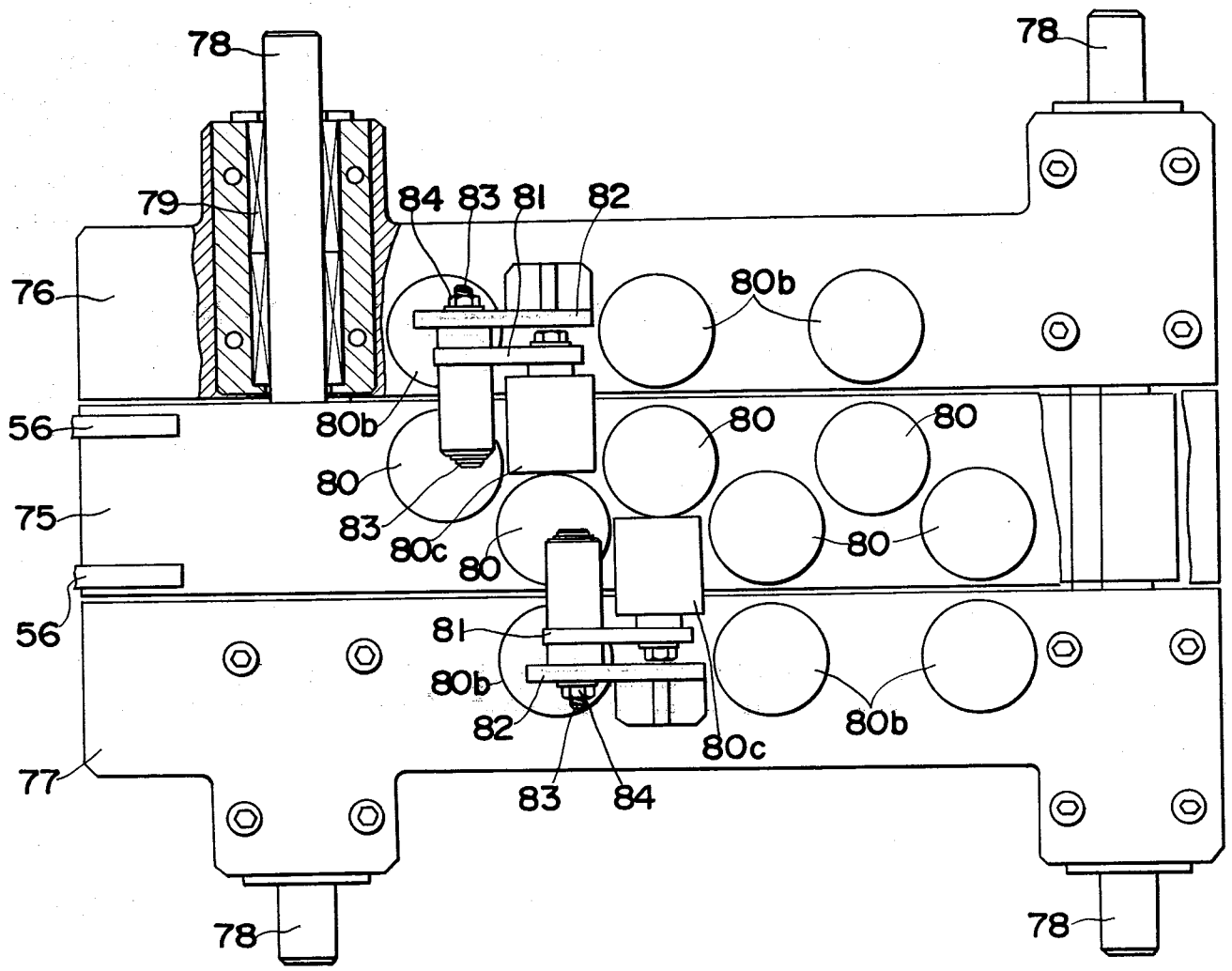
FIG. 10 is a plan view, partly in section, of a squaring-off and feed-out station employed in the apparatus of FIG. 1.

Referring to FIG. 10, the squaring-off and feed-out station E comprises a central fixed horizontal mount 75 and two movable horizontal mounts 76 and 77 which have upper surfaces level with and are provided on opposite sides of the central fixed mount 75. There are provided two shafts 78 which are fixedly mounted in opposite end portions of the central fixed mount 75, which are disposed at right-angles to the direction of travel of slats 14′ over the mounts 75 through 77, and which project beyond opposite sides of the central mount 75. In opposite end portions of each of the movable mounts 76 and 77 there are provided shaft bearing portions 79 permitting each of the movable mounts 76 and 77 to be slidably mounted on the ends of the shafts 78 projecting from one side of the central mount 75, the mounts 76 and 77 being movable towards or away from the central mount 75 in a line normal to the direction of travel of slat 14′. The moveable mounts 76 and 77 are strongly urged by springs not shown towards the central mount 75.

In line with and adjacent to each opposite side of the central mount 75 there is provided a line of three rolls 80, the rolls 80 in one line being staggered, in the direction of slat movement with respect to the rolls 80 in the other line, to permit the width of the central mount 75 to be generally equal to the spacing of slats 14′ imposed by the walls 56. All the rolls 80 are driven simultaneously by a motor, not shown, which is provided below the central mount 75, and the drive of which is transmitted via suitable gears 80*a* (see FIG. 1). In each movable mount 76 and 77 there is provided a line of three rolls 80*b* which are aligned with rolls 80 adjacent to the corresponding side of the central mount 75, and which are separated therefrom by a distance which is slightly less than the distance between two sides 14*b*′ of a slat 14′, i.e., slat sides which are not contacted by the rolls 67 and 69 in the smoothing station D. The rotational axis of all the rolls 80 and 80*b* is vertical, as opposed to that of the rolls 67 and 69 which is horizontal. The rolls 80 are actuated when slats 14′ guided by the walls 56 are advanced onto the squaring-off station E. A slat 14′ is still being forwarded by a roller 69 when the front end thereof reaches the first roll 80, and drive supplied by the roll 69 is sufficient to force the slat 14′ between the first roll 80 and the corresponding roll 80*b*, the movable mount 76 or 77 being moved slightly counter to the force of the springs by which they are loaded, after which the rolls 80 and 80*b*, while applying pressure on the slat sides 14*b*′, forward the slat 14′ to the discharge portal of the apparatus. To prevent slats 14′ from riding up when passing between rolls 80 and 80*b*, there is provided over the path of each slat 14′ a press-down roll 80*c*, which is rotatably mounted on a shaft fixedly attached to one end of an arm 81, the other end of which is mounted on a horizontal bolt 83. Each bolt 83 may be set to a particular height in a support piece 82 which is fixedly mounted on a movable mount 76 or 77. Each arm 81 may be allowed to turn on its corresponding bolt 83 or may be fixedly set relative thereto by means of a tightening nut 84. It is thus possible to vary the height of and hence the amount of pressure applied by each press-down roll 80*c*.

A certain time after the cutting unit B has reached the right-hand side of the apparatus as seen in FIG. 1, the clutch 26*a* is engaged and the motor 27 is actuated in reverse, whereby the cutting unit B is drawn to its initial position. After this the cylinders 96 are again actuated to cause the remainder 14*b* of the board to be pushed into contact with the stops 37*a*, and the cutting unit is again advanced to cut more slats 14′. This action is repeated until the width of the remaining board 14*b* is less than twice that of a slat 14′, which is detectable for example by microswitches connected in series and provided at one side of the cutting station A2. When this point is reached, the apparatus is stopped after discharge of the last severed slats 14′, the remaining portion of the board 14 is removed manually, and the apparatus start button or similar means is actuated manually, after which the abovedescribed series of actions is repeated automatically for the next board 14.

Needless to say actuation of various elements of the apparatus may be effected in response to actuation of microswitches or the like by previously actuated elements, or may be controlled on a time basis, by a timer unit.

What is claimed is:

1. A wood slicing apparatus comprising a cutting unit, driving means coupled to said cutting unit for driving said cutting unit in a rectilinear motion along a line entering a board-shaped base material from which portions are to be severed, and a support member for holding said board-shaped base material thereon, said cutting unit including at least one set of blade holding elements spaced from and opposed to each other at a predetermined spacing for accommodating said board-shaped base material therebetween and having a plurality of blade accommodating grooves therein, and a plurality of thin cutter blades in said grooves in said blade holding elements and each blade projecting from the opposed surfaces of said blade holding elements and the blades in each element being in a straight line with blades in one line being opposed to the blades in the other line, successive thin blades in each blade holding element projecting further toward the other blade holding element, the driving means moving the cutting unit in a direction relative to the base material for causing the blades projecting the least to engage the base material first, said thin blades being adjustably mounted in said grooves in said holder elements with respect to the distance said blades project toward each other, said blades projecting toward the opposed surfaces of said blade holding elements at an angle thereto with the cutting edges of said thin blades being on the edges of said thin blades facing the opposed blade holding element and the end of each thin blade and the cutting edge thereof being at an obtuse angle.

2. A wood slicing apparatus as claimed in claim 1, in which the blades in the holder element remote from said support member being offset in the direction of movement of the cutting unit from the blades in the other cutting unit a distance less than the spacing between blades, whereby said blades in the remove holder element engage the base material ahead of the corresponding blades on the other holder for holding the base material against said support member during cutting.

3. A wood slicing apparatus as claimed in claim 1 wherein said driving means comprises a chain having the opposite ends thereof connected to opposite ends of the cutting unit in the direction of movement thereof, a sprocket mechanism coupled to said chain, a sprocket driving mechanism coupled to said sprocket mechanism for driving said sprocket mechanism in forward rotation, reverse rotation and for stopping operation of said sprocket mechanism, and detection switch means coupled to said sprocket driving mechanism and engagable by said cutting unit at various positions of said cutting unit during its movement for controlling operation of said sprocket driving mechanism.

4. A wood slicing apparatus as claimed in claim 1 wherein said cutting unit comprises a plurality of said blade holding elements and cutting blades side by side in a direction transverse to the direction of movement of said cutting unit during severing.

5. A wood slicing apparatus as claimed in claim 1 further comprising transfer means for receiving severed portions from said cutting unit and transferring said severed portions, and pressure roll means for receiving severed portions from said transfer means and smoothing the surfaces of the severed portions, said pressure roll means including a pair of smoothing rollers which are provided on opposite sides of the transfer path of said severed portions for pressing against the opposite surfaces of said severed portions, and apressing roller for pressing said severed portions in a direction perpendicular to the direction in which said pair of smoothing rollers presses said severed portions.

6. A wood slicing apparatus as claimed in claim 5 wherein said transfer means for transferring portions severed by said cutting unit includes a receiving and transferring mechanism which is raisable and lowerable beneath the position at which said portions are severed from said base material and which includes means for positioning said severed portions with the side surfaces thereof in a forwarding direction for said severed portions, and belt conveyor means adjacent the lower position of said transferring mechanism for receiving the severed portions from said positioning means and forwarding them in the forwarding direction.

7. A wood slicing apparatus as claimed in claim 5 in which said pressure roll means further comprises feed-in means, said feed-in means including a feeding roller for feeding the severed portions forwarded from said transfer means into said smoothing rollers and position maintaining means between said feeding roller and said smoothing rollers for maintaining said severed portions in the forward direction during the feeding thereof to the smoothing rollers.

8. A wood slicing apparatus comprising a cutting unit, driving means for driving said cutting unit in rectilinear relative motion to a board-shaped base material to sever slats from said base material, smoothing rollers for smoothing surfaces of slats severed by said cutting unit, a transfer unit for receiving and transferring said slats severed by said cutting unit toward said smoothing rollers, and a feed-in unit for feeding said severed slats forwarded from said transfer means into said smoothing rollers, said cutting unit including a guide frame, a rectilinear rail member on which said guide frame is guided in its cutting movement, at least one set of blade holding elements on said guide frame spaced from and opposed to each other at a predetermined spacing for accommodating said board-shaped base material therebetween a plurality of thin cutter blades adjustably held on said blade holding elements and each blade projecting from the opposed surfaces of said blade holding elements and the blades in each element being in a straight line with the blades in one line being opposed to the blades in the other line, successive thin blades in each blade holding element projecting further toward the other blade holding element, the driving means moving the cutting unit in a direction relative to the base material for causing the blades projecting the least to engage the base material first, said blades projecting toward the opposed surfaces of said blade holding elements at an angle thereto with the cutting edges of said thin blades being on the edges of said thin blades facing the opposed blade holding element and the end of each thin blade and the cutting edge thereof being at an obtuse angle, each of said thin cutter blades being composed of equal length break-off portions with the joints therebetween being at the same angle to the cutting edge as the end of said thin blade is to the cutting edge, and a plurality of supporting levers each having a plurality of holes therethrough at intervals equal to the intervals between joints between said break-off portions, said supporting levers being provided at the rear of said cutter blades, and a securing member extending through one of said holes in each supporting lever for fixing said supporting levers to said holding elements in such a manner that the amount each of said cutting blades projects from said holding members is in accordance with the hole through which said securing members extends, said driving means including a chain having the opposite ends thereof connected to opposite ends of the cutting unit in the direction of movement thereof, a sprocket mechanism coupled to said chain, a sprocket driving mechanism coupled to said sprocket mechanism for driving said sprocket mechanism in forward rotation, reverse rotation and for stopping operation of said sprocket mechanism, and detection switch means coupled to said sprocket driving mechanism and engagable by said cutting unit at various positions of said cutting unit during its movement for controlling operation of said sprocket driving mechanism, said smoothing rollers being a pair of smoothing rollers which are provided on opposite sides of the transfer path of said slats for pressing against the opposite surfaces of said slats, and a pressing roller for pressing said slats in a direction perpendicular to the direction in which said pair of smoothing rollers presses said slats, raisable and lowerable beneath the position at which said slats are severed from said base material and which includes means for positioning said slats with the side surfaces thereof in a forwarding direction for said slats and belt conveyor means adjacent the lowered position of said transferring mechanism for receiving the slats from said positioning means and forwarding them in the forwarding direction, and feed-in means between said transfer means and said smoothing rollers and including a feeding roller for feeding the slates forwarded from said transfer means into said smoothing rollers and position maintaining means between said feeding roller and said smoothing rollers for maintaining said slats in the forwarding direction during the feeding thereof to the smoothing rollers.

* * * * *